US005124205A

United States Patent [19]

Raynolds et al.

[11] Patent Number: 5,124,205

[45] Date of Patent: Jun. 23, 1992

[54] INK RESERVOIR CONTAINING MODIFIED POLYESTER FIBERS

[75] Inventors: Peter W. Raynolds; Shriram Bagrodia, both of Kingsport, Tenn.

[73] Assignee: Eastman Kodak Company, Rochester, N.Y.

[21] Appl. No.: 603,088

[22] Filed: Oct. 25, 1990

Related U.S. Application Data

[60] Division of Ser. No. 471,444, Jan. 29, 1990, Pat. No. 4,966,107, which is a continuation-in-part of Ser. No. 299,904, Jan. 23, 1989, Pat. No. 4,954,398, which is a division of Ser. No. 157,551, Feb. 16, 1988, Pat. No. 4,842,792.

[51] Int. Cl.[5] ..... B32B 3/30; B34K 5/02; D02G 3/00

[52] U.S. Cl. ..... 428/364; 401/196; 401/198; 401/199; 401/292; 401/265; 428/373; 428/377; 428/397; 428/400; 428/401; 428/167; 428/171

[58] Field of Search ..... 401/196, 198, 199; 428/364, 373, 377, 397, 400, 401, 167, 171

[56] References Cited

U.S. PATENT DOCUMENTS

| | | | |
|---|---|---|---|
| 2,590,402 | 3/1952 | Hall et al. | 8/115.5 |
| 2,781,242 | 2/1957 | Knapp | 8/115.69 |
| 2,828,528 | 4/1958 | Gajjar | 28/76 |
| 3,135,577 | 6/1964 | Watson | 8/115.5 |
| 3,287,787 | 11/1966 | Goulding et al. | 264/340 |
| 3,485,120 | 12/1969 | Keith | 83/37 |
| 3,535,141 | 10/1970 | Marco | 117/47 |
| 4,008,044 | 2/1977 | Latta et al. | 8/115.5 |
| 4,063,887 | 12/1977 | Forschirm | 8/130.1 |
| 4,086,312 | 4/1978 | Midorikawa | 401/198 |
| 4,286,005 | 8/1981 | Berger | 428/167 |
| 4,287,146 | 9/1981 | Midorikawa | 401/198 |
| 4,291,442 | 9/1981 | Marco | 28/159 |
| 4,354,889 | 10/1982 | Berger | 156/180 |
| 4,370,143 | 1/1983 | Bauer | 8/493 |
| 4,391,872 | 7/1983 | Suzuki et al. | 428/224 |
| 4,457,644 | 7/1984 | Yokosuka | 401/199 X |
| 4,590,032 | 5/1986 | Phillips | 264/555 |
| 4,639,397 | 1/1987 | Sato et al. | 428/397 |
| 4,695,415 | 9/1987 | Setsuie et al. | 264/29 |
| 4,704,309 | 11/1987 | Coney et al. | 427/258 |
| 4,707,409 | 11/1987 | Phillips | 428/397 |
| 4,729,808 | 3/1988 | Berger | 156/180 |
| 4,772,491 | 9/1988 | Nealy et al. | 427/336 |
| 4,847,316 | 7/1989 | Schick et al. | 524/88 |
| 4,855,344 | 8/1989 | Nealy et al. | 524/86 |

FOREIGN PATENT DOCUMENTS

| | | | |
|---|---|---|---|
| 0122793 | 10/1984 | European Pat. Off. . | |
| 60-75638 | 4/1985 | Japan | 428/397 |
| 60-119220 | 6/1985 | Japan | 428/397 |
| 84/00179 | 1/1984 | PCT Int'l Appl. . | |

OTHER PUBLICATIONS

Sanders et al., *Journal of Applied Polymer Science,* 27, 4477 (1982).

Schwier, Defensive Publication No. T916,001, published Nov. 27, 1973.

Gorrafa, *Textile Chemists and Colourists,* 12, 83 (1980).

Liljemark et al., *Textile Research Journal,* 41, 732 (1971).

Raj Kumar et al., *Journal of Applied Polymer Science,* 33, 455 (1987).

Latta, *Textile Research Journal,* 54 (11), 766 (1984).

Gawish et al., *American Dyestuff Reporter,* 19 (Jul. 1986).

Shet et al., *Textile Chemist and Colorist,* 14 (11), 233/21 (1982).

*Chemical Abstract,* vol. 106, No. 16, Sec. 140, Abstract No. 121308 (Japanese Patent No. 86/152871), Jul. 11, 1986, Torary Industries, Inc.

Tomasino et al., *American Dyestuff Reporter,* 22 (Aug. 1982).

Mittal et al., *American Dyestuff Reporter,* 26 (Jun. 1985).

Houser, *Textile Chemist and Colorist,* 15(4), 70/37 (1983).

Valentin et al., *L'Industrie Textile,* 1122, 459 (May, 1982).

*Primary Examiner*—Lorraine T. Kendell

*Attorney, Agent, or Firm*—Thomas R. Savitsky; Betty J. Deaton; William P. Heath, Jr.

[57] ABSTRACT

Disclosed is a novel ink reservoir containing a polyester fiber, such as a poly(ethylene terephthalate) fiber, having at least one continuous groove. The surface of the groove of the fiber is preferably rougher than the surface outside the groove. The ink reservoirs are useful for use with aqueous inks and have improved ink transport properties.

2 Claims, 10 Drawing Sheets

INK RESERVOIR CONTAINING MODIFIED POLYESTER FIBERS

This is a divisional of copending application Ser. No. 07/471,444 filed on Jan. 29, 1990 now U.S. Pat. No. 4,996,107, which is a continuation-in-part of application Ser. No 299 904 filed Jan. 23, 1989, now U.S. Pat. No. 4,954,398 (incorporated herein by reference in its entirety) which is a division of Ser. No. 157,551 filed Feb. 16, 1988, now U.S. Pat. No. 4,842,792.

FIELD OF INVENTION

This invention concerns a novel ink reservoir, suitable for use with a writing instrument, which contains polyester fibers wherein each fiber has at least one continuous groove extending along the length thereof.

BACKGROUND OF THE INVENTION

Ink reservoirs for use with writing instruments such as the rollerball pen, porous tipped pens, highlighters and marking pens ("Magic" markers) have conventionally been formed of a fibrous bundle compacted together into a cylindrical or rod-shaped unit having longitudinal capillary passageways among the fibers which serve to hold and release the ink (see, for example, U.S. Pat. Nos. 4,729,808; 4,286,005; and 4,354,889). The reservoirs resemble cigarette filters in form, density and texture. The fibers of these reservoirs are typically either cellulose acetate (for water-based inks) or polyester (for toluene-based inks). Cellulose acetate is currently more expensive than polyester on a weight basis. It is believed that cellulose acetate fibers are extensively used for making ink reservoirs because of the ready availability of high denier bundles in the form of "filter-tow", which is sold to the makers of cigarette filters. Polyester is used with non-water-based inks because cellulose acetate is attacked by many common non-polar solvents.

Ink reservoirs known in the prior art which are made of polyester fibers have fiber cross-sections which are conventional (i.e., substantially round).

It would be desirable to have an ink reservoir containing polyester fiber that is suitable for use with water-based inks. Polyester fibers having non-conventional cross-sections (i.e., substantially non-round) are known in the art but are heretofore unknown to be useful in ink reservoirs (e.g., see U.S. Pat. Nos. 4,639,397; 4,590,032; 2,828,528; and 4,008,044). We have discovered an ink reservoir suitable for use with aqueous or water-based inks which makes use of polyester fibers containing grooves which extend along the length of the fiber (i.e., axially).

SUMMARY OF THE INVENTION

The present invention is directed to an ink reservoir for use with a writing instrument comprising a plurality of fibers wherein one or more individual fibers of said plurality of fibers is a fiber comprising a polyester material wherein said fiber has formed therein and extending along the length thereof at least one continuous groove. It is preferred that the groove of said fiber has a mean EB Roughness at the bottom of said groove of about 10% to about 600% higher than the mean EB Roughness outside said groove. The "EB Roughness" can be determined by the procedure hereinafter described.

$$0.06 \text{ millimeters (mm)} \leqq W < 0.10 \text{ mm},$$

$$6W < X_1 < 12W,$$

$$2W < X_3 < 6W,$$

$$3W \leqq X_2 \leqq 6W \text{ and}$$

$$W \leqq R \leqq 3W.$$

Figure 9:
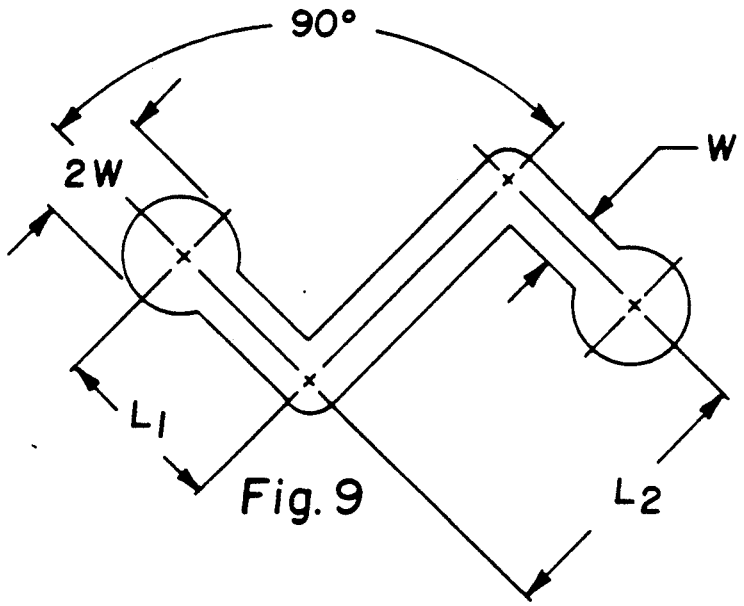

FIG. 9—Schematic representation of a spinnerette orifice which will form a polyester fiber having two continuous grooves. The scale is about 100:1. The dimensions are as follows: $L_1=3.1W$; $L_2=5.1W$; and $W=0.075$ mm. Such an orifice will produce a fiber cross-section substantially as described in FIG. 5.

Figure 10:
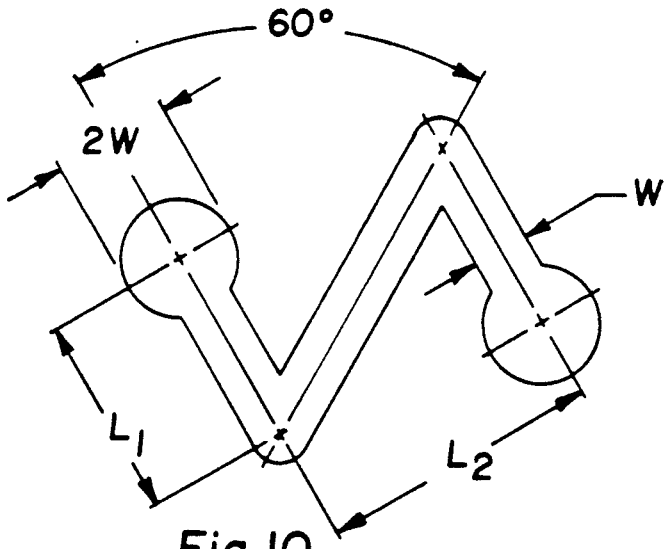

FIG. 10—Schematic representation of a spinnerette orifice which will form a polyester fiber having two continuous grooves. The scale is about 100:1. The dimensions are as follows: $L_1=3.5W$; $L_2=5.8W$; and $W=0.075$ mm.

Figure 11:
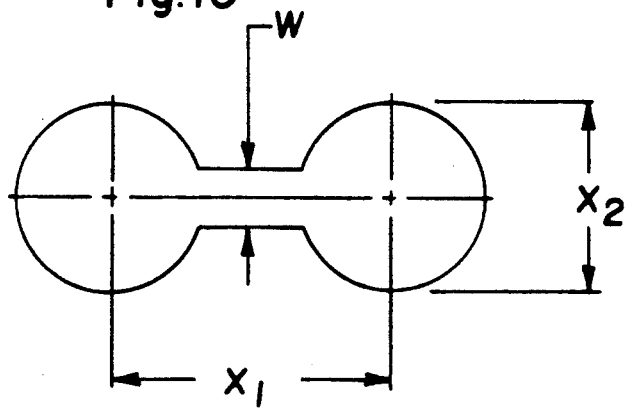

FIG. 11—Schematic representation of a spinnerette orifice having a "dumb-bell" shape which will form a polyester fiber having two continuous grooves. The scale is about 100:1. The dimensions are as follows: W is about 0.065 mm to about 0.084 mm; $5W \leqq X_1 < 7W$; and $3W \leqq X_2 \leqq 4W$. This orifice will produce a fiber cross-section substantially as described in FIGS. 3 and 14.

Figure 8:
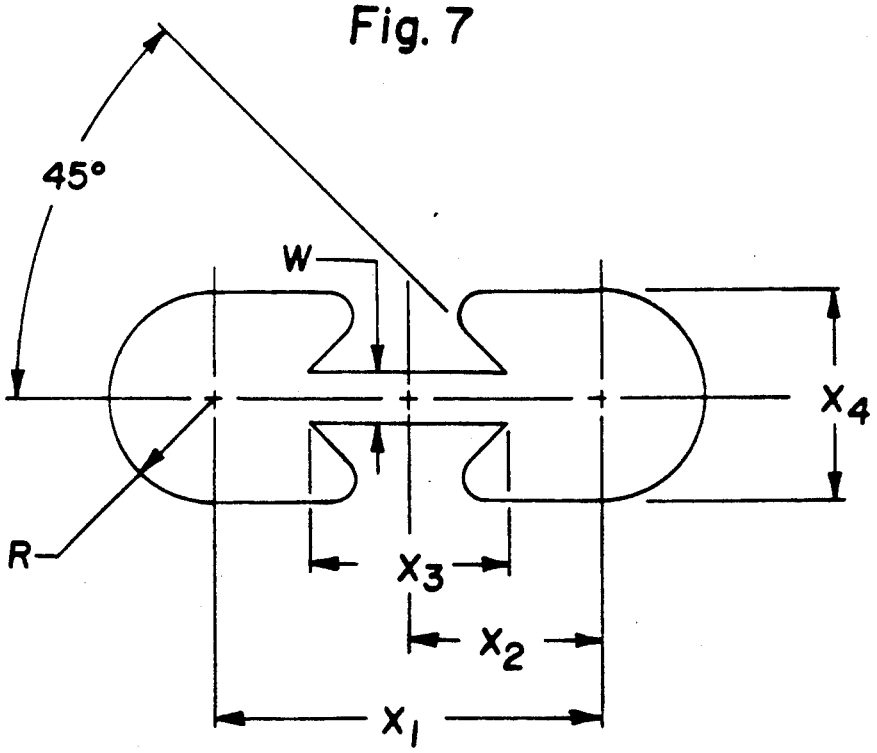
FIG. 8—Schematic representation of a spinnerette orifice which will form a polyester fiber having two continuous grooves. The particular dimensions are as follows.
Figures 12, 14:
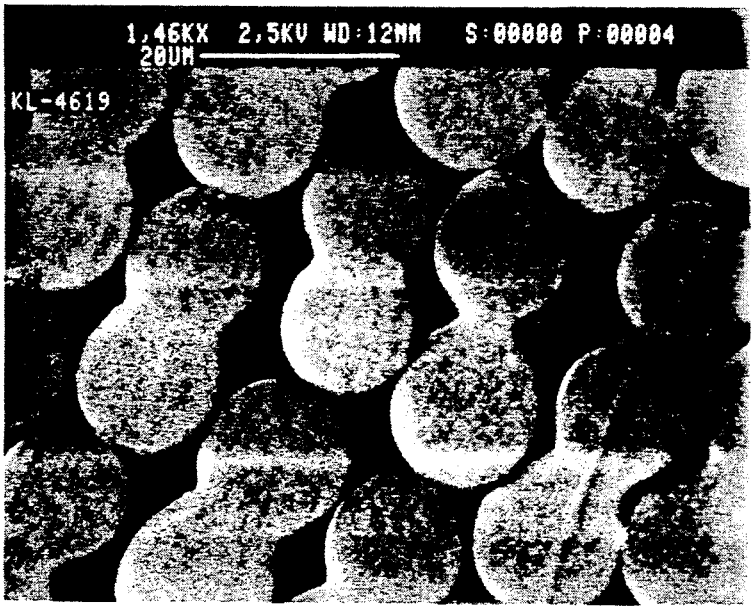

FIG. 12—Photomicrograph of a cross-section of poly(ethylene terephthalate) fibers having two continuous grooves that are formed by the spinnerette hole described in FIG. 8 wherein $X_1=8W$; $X_3=4W$; $X_2=4W$; $X_4=4W$; and $W=0.065$ mm.

Figure 13:
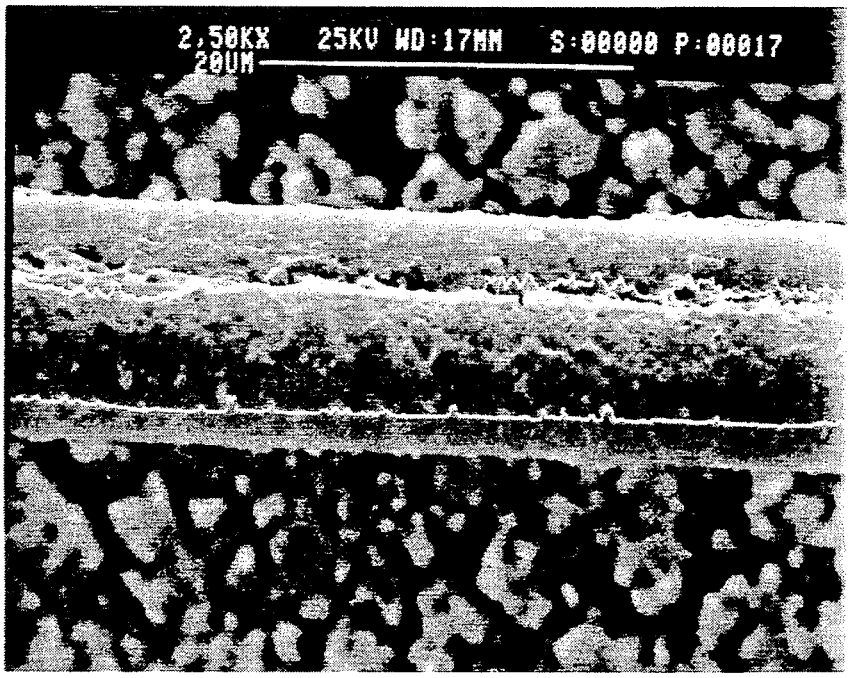

FIG. 13—Scanning election microscope (SEM) photomicrograph of a poly(ethylene terephthalate) fiber having two grooves. This fiber is within the scope of the present invention and was formed by the process of the present invention. Also shown are representative line-scans; one outside the groove and one at the bottom of the groove. The magnification is 2,540×.

Figure 3:
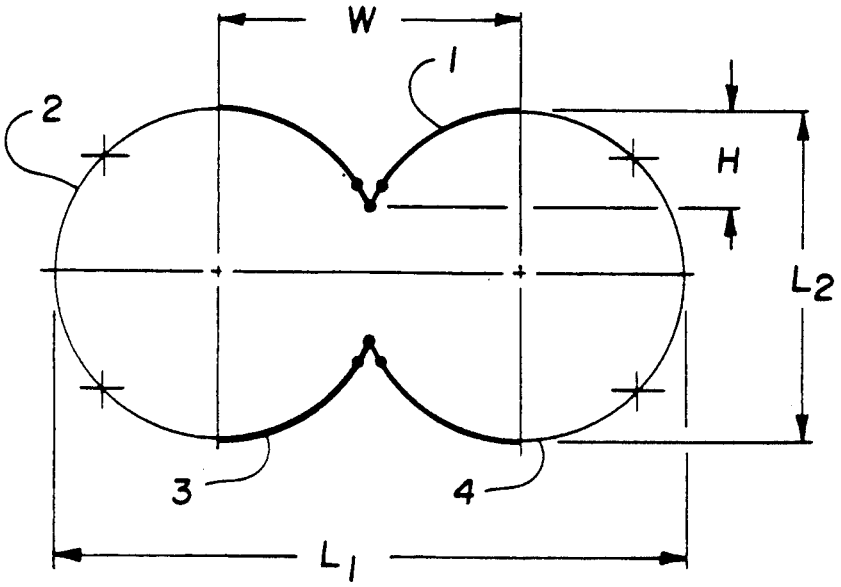
FIG. 3—Schematic representation of a cross-section of a spun polyester fiber having two grooves. $L_1$ is the major axis; $L_2$ is the minor axis; W is width of the groove, H is height of the groove, the "+" symbols represent points outside a groove, the "•" symbols represent points at the bottom of the groove; the thicker lines (1, 3) represent the surfaces of the grooves; and the thinner lines (2, 4) represent the surfaces outside the grooves.
Figure 4:
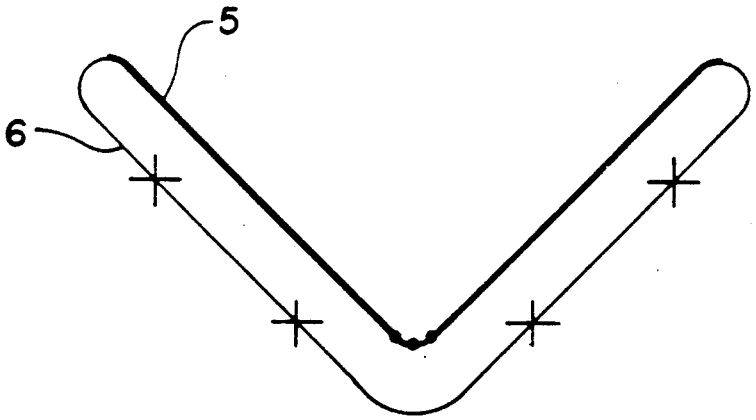
FIG. 4—Schematic representation of a cross-section of a polyester fiber having one groove. The "+" symbols represents points outside the groove; the "•" symbols represent points at the bottom of the groove; the thicker line (5) represents the surface of the groove; and the thinner line (6) represents the surface outside the groove.

Prior to the hydrolysis, such fiber would have a cross-section substantially as described in FIGS. 3 and 14, and would be formed by a spinnerette substantially as described in FIG. 11.

FIG. 14—Photomicrograph of cross-section of poly-(ethylene terephthalate) fibers having two continuous grooves that are formed by spinnerettes substantially as described in FIG. 11. A schematic of this fiber cross-section is shown in FIG. 3. The particular dimensions of the fiber cross-section of FIG. 14 are as follows: $L_1=38.7\ \mu$; $L_2=19.4\ \mu$; $W=19.6\ \mu$; $H=4.7\ \mu$; and $L_1/L_2=2.0$·[$\mu=10^{-6}$ meter].

Figure 15:
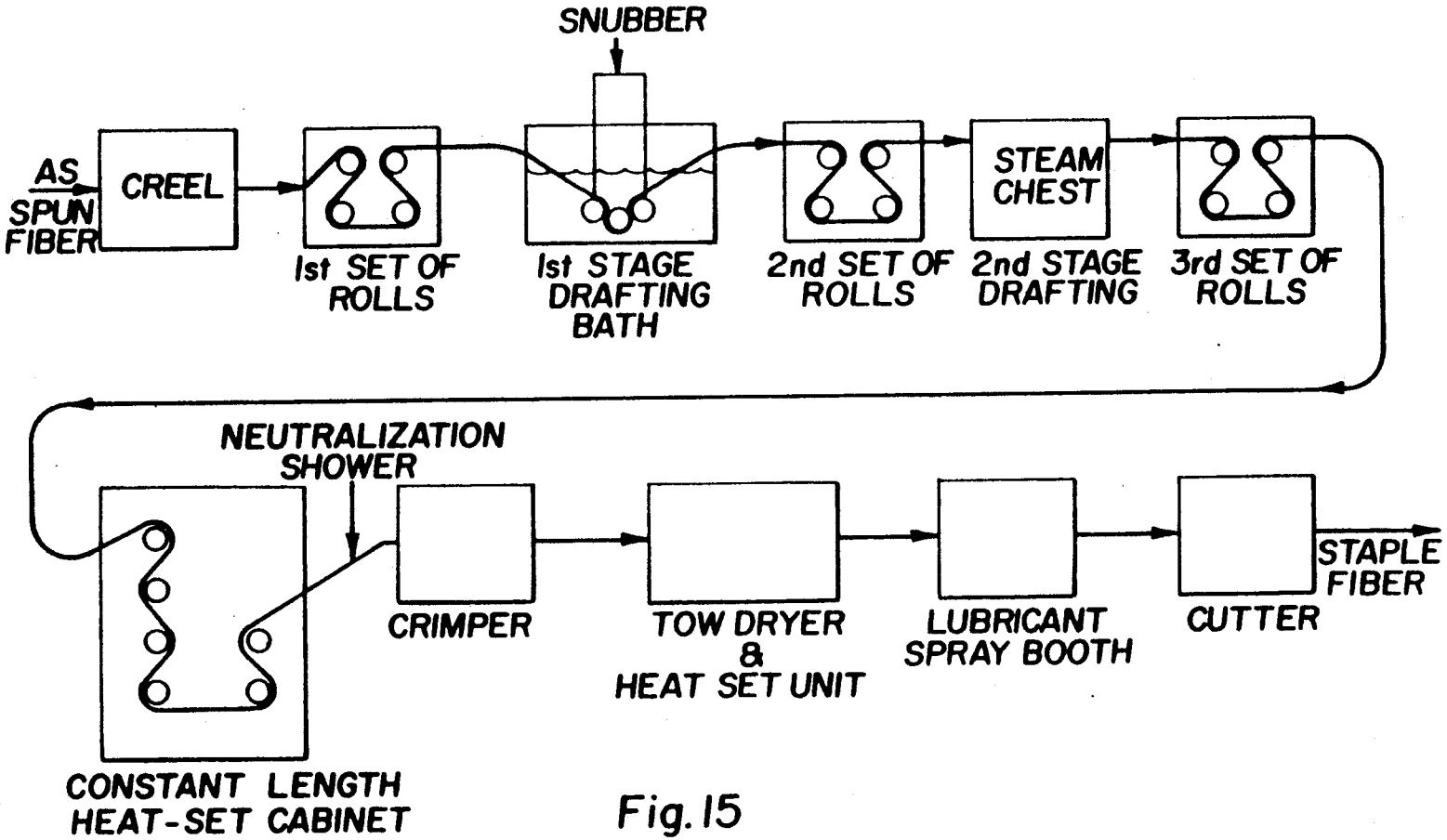

FIG. 15—Schematic flow chart of a preferred tow processing operation within the scope of the present invention. The alkaline solution and, optionally, accelerant are present in the 1st Stage Drafting Bath.

Figure 16:
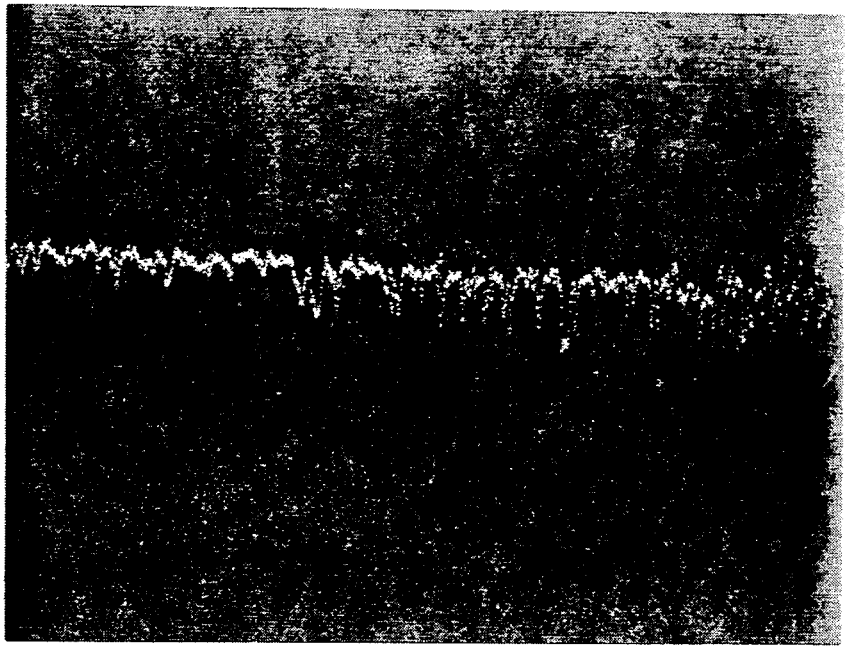

FIG. 16—Line-scan profile of Example 2 at the bottom of a groove.

Figure 17:
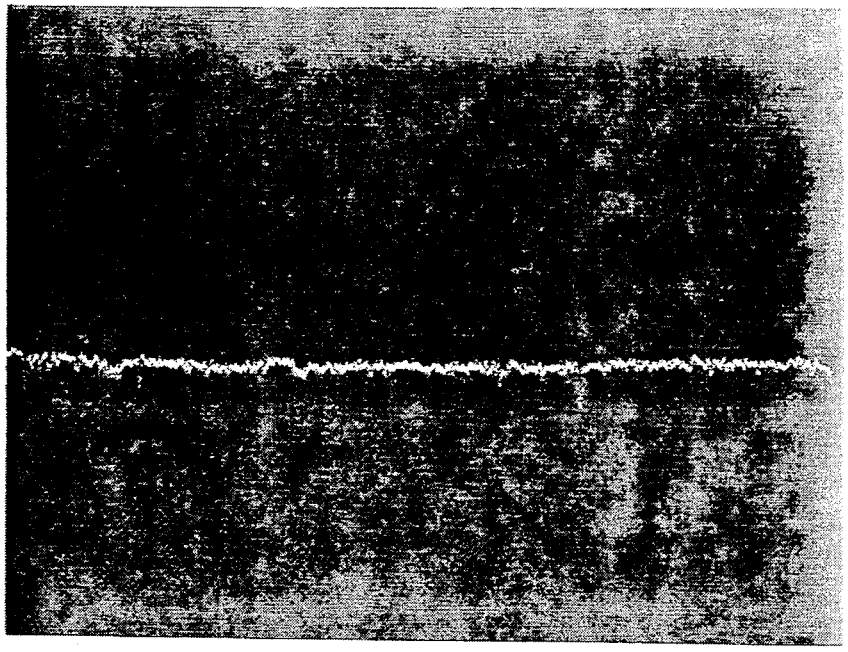

FIG. 17—Line-scan profile of Example 2 outside a groove.

Figure 18:
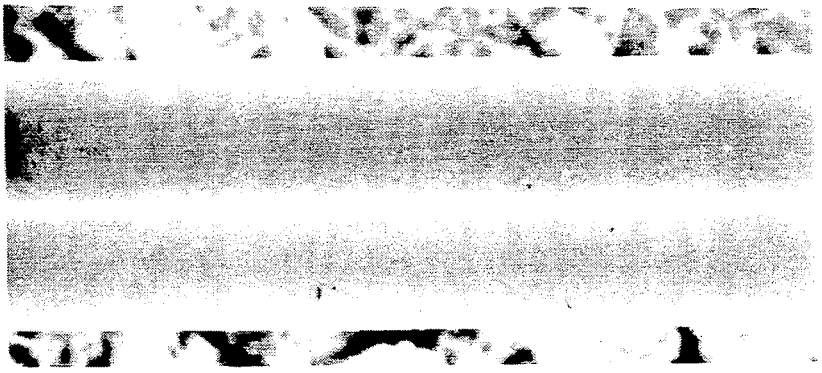

FIG. 18—SEM photomicrograph of a fiber drafted in water as described in Example 1.

Figure 19:
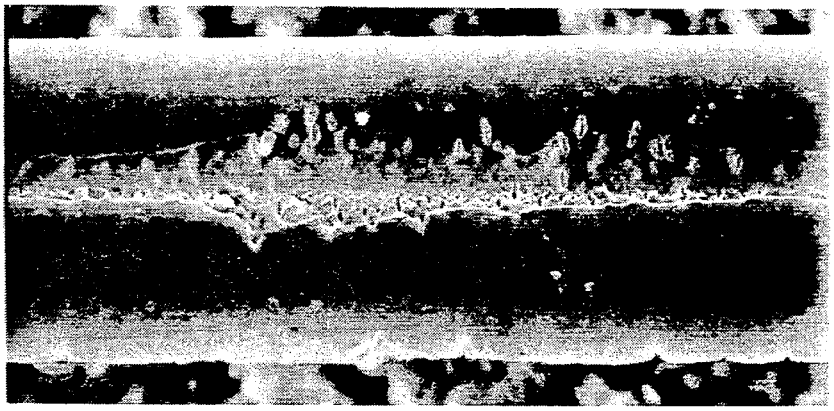

FIG. 19—SEM photomicrograph of a fiber drafted in 1.7% NaOH as described in Example 2.

Figure 20:
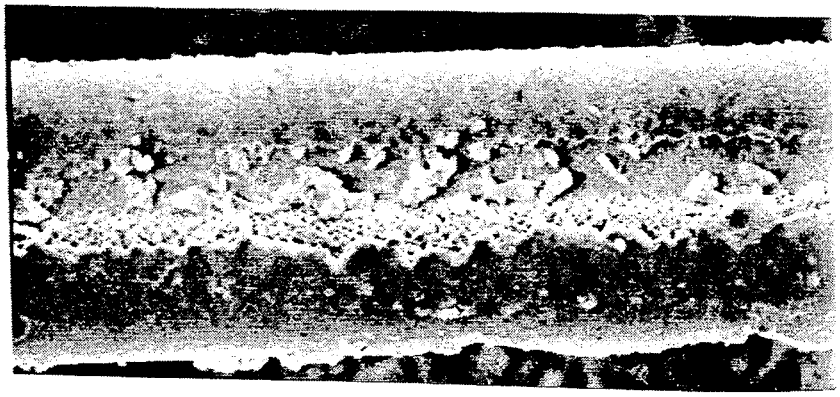

FIG. 20—SEM photomicrograph of a fiber drafted in 7.5% NaOH as described in Example 3.

DETAILED DESCRIPTION OF THE INVENTION

The ink reservoir of the present invention is in substantially cylindrical or rod-like form. The length of the ink reservoir is typically about 0.5 centimeter (cm) to about 30 cm, preferably about 1 cm to about 20 cm and more preferably about 6 cm to about 10 cm. The diameter of the ink reservoir is typically about 0.1 cm to about 5 cm, preferably about 0.2 cm to about 3 cm, and more preferably about 0.4 cm to about 0.8 cm. A typical ink reservoir will have a length of about 8 cm and a diameter of about 0.6 cm. The ink reservoir can be made by conventional means using the fibers described herein. The density of the fiber bundle (i.e., the plurality of fibers) of the ink reservoir is typically about 0.1 to about 1 gram (g)/cubic centimeter (cc), preferably about 0.2 to about 0.8 g/cc and more preferably about 0.3 to about 0.4 g/cc.

In the ink reservoir of the invention, it is preferred that a major portion of said plurality of fibers comprises a polyester material wherein each of said fibers of said major portion has formed therein and extending along the length thereof at least one continuous groove. It is more preferred that substantially all of said plurality of fibers comprise a polyester material wherein each of said fibers has formed therein and extending along the length thereof at least one continuous groove.

The ink reservoir of the invention can optionally be overwrapped with a material substantially impervious to the ink. Such a material can be a polyolefin such as polyethylene or a polyester such as poly(ethylene terephthalate). The overwrap is typically open at one or both ends (i.e., top and bottom of the cylindrical form) to allow for adequate movement of the ink during use.

The fibers in the ink reservoirs are preferentially oriented substantially longitudinally along the center axis of the cylindrical form, since such orientation provides for a good transport or movement of the ink from the end of the reservoir most distal to the writing instrument point to the end most proximal to the writing instrument point. However, the fibers of ink reservoirs of the invention can be of a more random orientation and the invention is not limited to a specific fiber orientation.

The fibers in the ink reservoirs of the present invention can be of any length or shape (e.g., can be crimped, crenulated or zig-zagged). Regarding length, the fibers can be cut to various sizes, e.g. 0.5 inch or higher, but it is preferred that the fibers of the fiber bundle are substantially the same length as the ink reservoir.

The fibers of the ink reservoirs of the present invention can optionally be physically bonded or fused together by conventional means known in the art, e.g., by the use of heat and/or pressure. Heat bonding of a typical fiber bundle can be achieved by heating the fiber bundle at about 120° C. to about 250° C. for about ½ minute to about 5 minutes.

The ink reservoirs of the invention can also optionally contain other additives, which can be designed, for example, to enhance wettability and/or flow characteristics of the ink. Such additives include block copolymers of ethylene and propylene oxide that are commonly used as surfactants, polymeric organosilicone compounds that are commonly used as surfactants, surfactants derived from long chain aliphatic and aromatic carboxylic and sulfonic acids, and other surfactants commonly used to improve the wettability of a surface. These additives are typically present in an amount of about 0.01 to about 3 weight %, based on the total weight of the fiber bundle.

The aqueous or water-based inks which can be used in the present invention are those known in the art, for example, those described in U.S. Pat. Nos. 4,772,491; 4,847,316; 4,855,344; and 4,704,309, incorporated herein by reference in their entirety.

The writing instruments which can utilize the ink reservoirs of the present invention can be any writing instrument known in the art which can be used with aqueous inks. Such writing instruments include roller-ball pens, porous tipped pens, highlighters and marking pens.

Preferred fibers used to make ink reservoirs of the invention can be made by a drafting process for preparing a modified polyester fiber comprising:

hydrolyzing an unhydrolyzed polyester fiber having formed therein and extending along the length thereof at least one continuous groove, said hydrolyzing occurring to the extent necessary to modify said polyester fiber such that the mean EB Roughness at the bottom of said groove is about 10% to about 600% higher than the mean EB Roughness outside said groove.

A more preferred process for preparing the desired preferred fibers comprises the steps of:

(a) contacting an alkaline medium and an unhydrolyzed polyester fiber having formed therein and extending along the length thereof at least one continuous groove, and (b) heating and drafting the filament treated by step (a) to the extent necessary to modify said polyester fiber such that the mean EB Roughness at the bottom of said groove is about 10% to about 600% higher than the mean EB Roughness outside said groove.

As used herein, the term "filament" shall be used interchangeably with the term "fiber."

The polyester materials useful to make the fibers of the ink reservoirs of the present invention are polyesters or copolyesters that are well known in the art and can be prepared using standard techniques, such as, by polymerizing dicarboxylic acids or esters thereof and glycols. The dicarboxylic acid compounds used in the production of polyesters and copolyesters are well known to those skilled in the art and illustratively include terephthalic acid, isophthalic acid, p,p'-diphenyldicarboxylic acid, p,p'-dicarboxydiphenyl ethane, p,p'-dicarboxydiphenyl hexane, p,p'-dicarboxydiphenyl ether, p,p'-dicarboxyphenoxy ethane, and the like, and the dialkylesters thereof that contain from 1 to about 5 carbon atoms in the alkyl groups thereof.

Suitable aliphatic glycols for the production of polyesters and copolyesters are the acyclic and alicyclic aliphatic glycols having from 2 to 10 carbon atoms, especially those represented by the general formula $HO(CH_2)_pOH$, wherein p is an integer having a value of from 2 to about 10, such as ethylene glycol, trimethylene glycol, tetramethylene glycol, and pentamethylene glycol, decamethylene glycol, and the like.

Other known suitable aliphatic glycols include 1,4-cyclohexanedimethanol, 3-ethyl-1,5-pentanediol, 1,4-xylylene, glycol, 2,2,4,4-tetramethyl-1,3-cyclobutanediol, and the like. One can also have present a hydroxylcarboxyl compound such as 4,-hydroxybenzoic acid, 4-hydroxyethoxybenzoic acid, or any of the other hydroxylcarboxyl compounds known as useful to those skilled in the art.

It is also known that mixtures of the above dicarboxylic acid compounds or mixtures of the aliphatic glycols can be used and that a minor amount of the dicarboxylic acid component, generally up to about 10 mole percent, can be replaced by other acids or modifiers such as adipic acid, sebacic acid, or the esters thereof, or with modifiers that impart improved dyeability to the polymers. In addition one can also include pigments, delusterants or optical brighteners by the known procedures and in the known amounts.

The most preferred polyester for use to make the fibers of the ink reservoir of the present invention is poly(ethylene terephthalate) ("PET").

To determine surface roughness, the fiber samples are scoured in hot distilled water at 80° C. for 5 minutes and then rinsed in distilled water at ambient temperatures for 5 minutes. The fiber samples are subsequently dried at ambient conditions for a period of at least 24 hours before being subjected to roughness measurements. The surface roughness is measured by a method which employs a scanning electron microscope (SEM) operating in a "line-scan" mode and a digitizing pad operated by a small computer. The SEM (Model S-200 manufactured by Cambridge Instruments Limited) is operated at 25 KV accelerating voltage, 19 mm working distance, and a magnification of 2,540×. The signal used for the "line-scan" output is the secondary electron signal, which is proportional to the local slope of the sample surface. Thus, monitoring of the secondary electron signal as it varies along a straight line path on a sample's surface is indicative of the sample's surface topography. In other words, the heights of the "peaks and valleys" of the line-scan output, as illustrated in FIGS. 13, 16 and 17, correlate with the heights of the "peaks and valleys" of the sample's surface. By measuring the average deviation of the position of the line-scan output, the surface "roughness" can be determined quantitatively. In practice, this is accomplished by recording the line-scan output on Polaroid® Type 52 film and measuring the vertical deviations at 1 millimeter increments along the X-axis. A digitizing pad (Houston Instruments "Hipad" model) interfaced to a microcomputer (Apple IIe) is used for the measurements and calculations. The surface roughness is defined by the following:

$$EB\ \text{Roughness} = \sqrt{\frac{1}{n} * \sum_{i=1}^{n} (Y_i - \bar{Y})^2}$$

where $Y_i$ is the height on the Y-axis of the line-scan profile at a particular point, $\bar{Y}$ is a mean value of the height, and n is the number of points (usually 80 to 85 in a 4 to 4½ inch distance (on the Polaroid film) along the X-axis). Calibration of the EB Roughness in microns is accomplished by measuring a ceramic surface whose surface roughness has been accurately measured by a stylus-type, surface profile instrument. Line-scan profiles are obtained for this ceramic standard and the fiber samples under identical conditions of operation of the SEM. The surface roughness value ultimately obtained is an average of measurements for 25 separate line-scan profiles which is defined herein as "mean EB Roughness." One can also measure "EB Roughness" by tapping the electronic signal directly and processing the information to obtain an EB Roughness value according to the above formula.

It is preferred that the mean EB Roughness at the bottom of the groove is about 0.08 micrometers ($\mu$) to about 0.37 $\mu$ and that the mean EB Roughness outside the groove is about 0.06 m to about 0.20 $\mu$; more preferred is that the mean EB Roughness at the bottom of the groove is about 0.10 $\mu$ to about 0.26 m and that the mean EB Roughness outside the groove is about 0.06 $\mu$ to about 0.15 $\mu$. "At the bottom" of a groove is about the minimum point of depression of the groove. Practically, it is as close to the actual minimum depression point as possible; typically line-scan profiles are taken at an area that is within 10% of the width (W) of the groove on either side of the actual minimum point of depression, and preferably within 5% of W. Typical places of measurements that are within the definition of "at the bottom" of a groove are shown in FIGS. 3-7 and are designated "•". For determining the EB Roughness outside the groove, the line-scan profile can be made at any site outside the groove. Typical examples of such sites are shown in FIGS. 3-7 and are designated "+".

In the fibers of the ink reservoirs of the invention, the fiber surface outside the groove is preferably smoother than the fiber surface inside the groove; therefore, the mean EB Roughness at the bottom of the groove is preferably a higher value than the mean EB Roughness at a typical location outside said groove. Typically, the mean EB Roughness value at the bottom of the groove is between about 10% and about 600% higher than the mean EB Roughness value outside said groove, and preferred is between about 25% and 500% higher.

The fibers useful in the present invention have at least one continuous groove or channel. The term continuous "groove" or "channel" means that the fiber cross-section has a specific geometry. This geometry can be expressed mathematically as follows:

The ratio of the width of the groove, W, and the height of the groove, H, W/H, must satisfy the following equation:

$$0.15 \leqq W/H \leqq 8.0,$$

and preferably $$2.5 \leqq W/H \leqq 6.5$$

Figure 1:
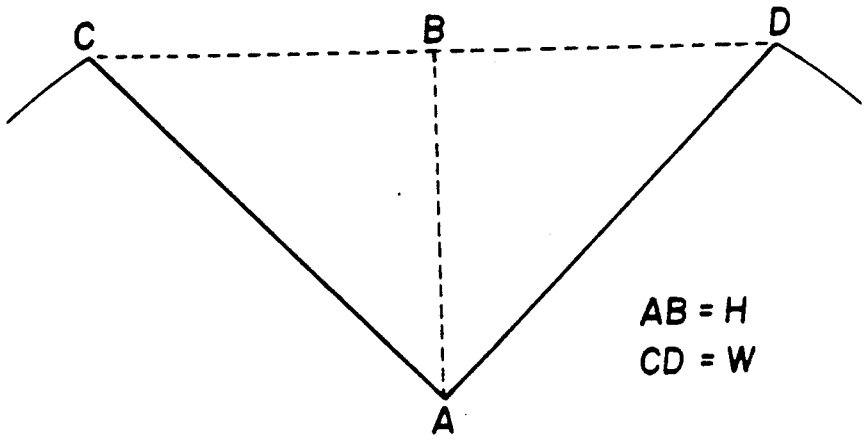
FIG. 1—Schematic representation of a "triangular" groove in a polyester fiber.

For example, for the "triangular" groove in FIG. 1, AB is the height of the groove, H. Line CD is drawn tangent to the groove surface. The width of the groove is then defined as CD = W.

Figure 2:
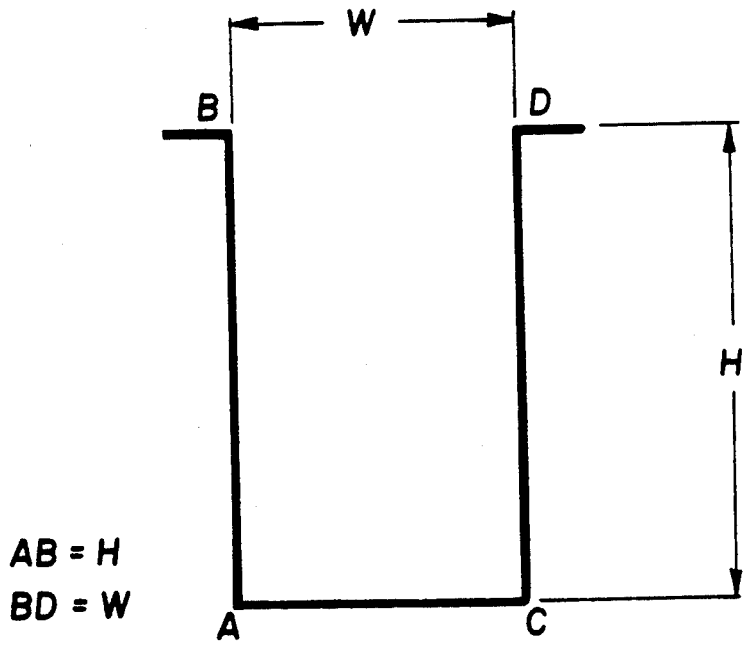
FIG. 2—Schematic representation of a "rectangular" groove in a polyester fiber.

Likewise, for a "rectangular" groove, as shown in FIG. 2, AB (or CD) is height of the groove, H and BD (and, in this particular case, AC) is width of the groove, W.

Examples of fiber cross-sections useful for the present invention are illustrated in FIGS. 3–7.

Examples of spinnerette orifices useful to make fibers having at least one continuous groove useful for the present invention are shown in FIGS. 8–11. The spinnerette orifice as shown in FIG. 8 will produce fiber cross-section having two relatively deep grooves; such a cross-section is illustrated in the SEM shown in FIG. 12. For FIG. 8 it is preferred that the dimension "W" is about 0.065 mm.

The grooved fibers useful in the present invention (prior to forming a rough groove surface, if desired) can be made using fiber-forming technology described hereinafter using known and the novel spinnerettes as described herein.

Other grooved fibers and spinnerettes used to make such fibers useful for the present invention are described in, for example, U.S. Pat. No. 4,707,409.

Fibers of the present invention have at least one continuous groove and preferably 2 to 6 continuous grooves. Preferred fibers of the present invention have a cross-section wherein the ratio of the major axis to the minor axis $(L_1)/(L_2)$ is $>1.2$, preferably:

$$1.5 < L_1/L_2 < 4.5.$$

FIG. 14 illustrates a preferred cross-section wherein $L_1/L_2$ is 2.

For the polyester fiber having a cross-section substantially as described in FIG. 14, it is preferred that $1.7 \leqq L_1/L_2 \leqq 2.3$ and $3 \leqq W/H \leqq 5$.

The preferred process to make fibers useful in the present invention takes place during the drafting stage of fiber production. Conventionally, polyester for staple fiber is drafted in water and steam medium (two-step process). In a more preferred process polyester fibers are drafted first in an alkaline solution, immediately followed by the second stage drafting in superheated steam medium. Subsequently, the fibers may be heat set at high temperatures (e.g., >130° C.) under constrained or relaxed conditions. Such a process is schematically represented in FIG. 15.

The selective hydrolysis described herein resulting in one or more groove surfaces having a rough texture is preferably carried out by use of an alkaline aqueous medium, typically by contacting the grooved fibers with such a medium in a first-stage drafting process. However, other means of accomplishing the desired selective surface hydrolysis of the grooved fibers are also contemplated.

A preferred alkaline medium for the preferred process is about a 0.5% to 10% by weight aqueous solution of an alkaline material, more preferred is about 1% to 4%. Suitable alkaline materials include alkali metal hydroxides such as sodium hydroxide, which is preferred because of availability and low cost, potassium hydroxide; as well as salts thereof derived from weak acids (pH of at least 12 in 0.1N aqueous solution). Examples of such salts include alkali metal sulfides, alkali metal sulfites, alkali metal phosphates, and alkali metal silicates. Other suitable alkaline materials include calcium hydroxide, barium hydroxide, strontium hydroxide, and the like. It is expected that organic alkaline materials, such as triethanol amine, will typically require more severe reaction conditions (e.g., higher concentration, higher temperature) than those required for inorganic alkaline materials.

It is preferred that the temperature of the alkaline medium in the first-stage draft bath is between about 50° and about 95° C., more preferred is between about 60° and about 85° C.; and it is preferred that the contact time is between about 1 and about 30 seconds, more preferred is between about 2 and about 20 seconds, although the contact time during the first-stage draft is not critical. As used in this context, "contact time" refers to the time the entire fiber is contacted with the alkaline bath, i.e., totally immersed or submerged in the solution. As is readily apparent, after the fibers are removed from the alkaline solution, selected portions of the fiber (particularly the grooves) are still in contact with residual alkaline solution.

As the fibers emerge from the first-stage draft bath containing alkaline solution after being drawn under typical conditions (e.g., contact time of 2–6 seconds, temperature of bath of about 58°–78° C.), essentially no significant hydrolysis has yet taken place. The concentration of the alkaline solution retained on the fibers as the fibers emerge from the first-stage draft bath is the same as the concentration of the alkaline solution in the first-stage draft bath.

Heat treatment following removal of the fibers from the alkaline medium preferably takes place in a second-stage draft which then results in the alkali treated fibers being selectively hydrolyzed which results in one or more groove surfaces having a rough texture. Heat treatment can also occur subsequent to a second-stage draft, e.g., when the fibers are subjected to a heat-set cabinet. It is preferred that the heat treatment is between about 100° C. to 240° C. for about 1 second to 1 minute, more preferred is about 130° to 210° C. for about 2 seconds to 30 seconds. Although it is not desired to be bound by any particular theory or mechanism, it is believed that after removal of the fibers from the alkaline bath, the alkaline solution is preferentially retained in the fiber groove(s) due to thermodynamic principles. As the fibers now pass through the second-stage drafting unit, it is believed that several processes occur simultaneously. For example, the alkaline solution retained on the fibers is being concentrated due to evaporation; furthermore, heat transfer takes place to the fibers. Thus, there is a dynamic process present involving heat transfer, mass transfer, and chemical reaction during the second-stage drafting and in the subsequent heat-set unit which produces the fibers of the present invention. The hydrolysis actually takes place during the second stage of drafting and subsequent heat setting operations.

The preferred hydrolysis process described herein must take place during drafting (and subsequent heat setting process, if any). The amount of draft is higher than the natural draw ratio of the fibers, but less that amount that will result in breaking of the fibers during drafting. The extent of draft will result in fibers having desired tenacity and elongation. In a preferred process using PET fibers, a typical overall draw ratio is about 2.5 to about 4.0, more preferred is about 3.0 to about 3.6.

The fibers treated by the hydrolysis process described herein have less than 5 weight percent loss as compared to untreated fibers, preferably less than 2 weight percent, and most preferably less than 0.5 weight percent.

Since the preferred filaments useful in the ink reservoirs of this invention have a cross-section with a major axis longer than a minor axis, these filaments have a preferred bending direction. Due to this preferred bending direction, such a filament will have a reduced bending rigidity relative to an equivalent denier fiber of circular or round cross-section.

To facilitate the hydrolysis reaction described herein using an alkaline solution, an accelerant can optionally be employed. The concentration is not critical as long as the desired hydrolyzed fibers are formed. In the preferred two-stage drafting process of the present invention the accelerant can be conveniently added to the alkaline medium typically at a concentration of 0.01 to 0.5 weight percent more preferably 0.05 to 0.2 weight percent. Suitable accelerators are quaternary ammonium salts and a preferred accelerator is Merse 7F® quaternary ammonium salt accelerator (available from Sybron Chemicals, Inc.).

As appreciated by a skilled artisan, the process described herein can optionally include the steps of drying, crimping, lubricating and cutting of the alkali/heat treated fibers. Such optional steps are illustrated in FIG. 15. In addition, it is preferred that the alkali/heat treated fibers are neutralized by a neutralization step involving treatment with an acid such as acetic acid (also illustrated in FIG. 15).

FIG. 13 is an SEM photomicrograph of a preferred PET fiber useful for forming ink reservoirs of the present invention. The fiber has a cross-section substantially as described in FIG. 14 and is made by a spinnerette substantially as described in FIG. 11. The fiber had been treated by the alkali hydrolysis process of the present invention and the increased roughness of the groove surface as compared to the nongroove surface is clearly evident. Also shown are two line scans, one at the bottom of the shown groove and one at a nongroove surface. FIG. 14 is an SEM photomicrograph of cross-sections of similar fibers (prior to alkali hydrolysis).

The fibers useful in the present invention have a groove the surface of which is believed to be sub-stantially hydrophilic. This characteristic is manifested by knitted fabrics made from such fibers which have improved wettability.

Continuous tow can also be made from the fibers described herein and such tow typically has a denier of about 20,000 to 100,000. Such tows may be used to make the ink reservoirs of the present invention by conventional technology known in the art.

The following examples are to illustrate the invention but should not be interpreted as a limitation thereon.

The test methods and steps of melt extrusion, tow processing, and textile processing used where applicable in the following examples are briefly described below. The extruder consists of a 2.5 inch diameter, Davis-standard, 20:1 length/diameter ratio extruder. The barrel is heated with 4 cast aluminum heaters plus four cartridge heaters in the barrel extension. The feed throat is water cooled. The extruder is fed from a feed bin containing polymer which has been dried in an earlier separate drying operation to a moisture level of $\leqq 0.003$ weight percent. Pellet polyethylene terephthalate polymer (PET) with an I.V. of 0.60 and 0.3 weight percent $TiO_2$ enters the feed port of the screw where it is heated and melted as it is conveyed horizontally in the screw. I.V. is the inherent viscosity as measured at 25° C. at a polymer concentration of 0.50 g/100 mL in a suitable solvent such as a mixture of 60% phenol and 40% tetrachloroethane by weight. The extruder has four heating zones of about equal length which are controlled, starting at the feed end at a temperature of 280°, 290°, 300°, and 310° C., respectively. The rotational speed of the screw is controlled to maintain a constant pressure in the melt [1,000 pounds per square inch (psi)]as it exits from the screw to the candle filter. The candle filter is wrapped with one 30-mesh screen and three wraps of 180-mesh screen. The molten polymer from the pump is metered to a jet assembly which consist of a filtering medium and a spinnerette plate.

The screens in the jet assembly consist of 1 layer of 20 mesh, 2 layers of 325 mesh, and 1 layer of 80 mesh screens. The quench air flow in the spinning cabinet is maintained at 290 feet per minute (fpm). Spinning lubricant is applied via ceramic kiss rolls. The godet rolls are maintained at 1,000 meters per minute (MPM) and packages are wound on a Leesona winder. The tow may also be puddled into boxes for subsequent processing. Several packages are spun for creeling in the tow processing step.

Tow Processing

There are several steps involved in the tow processing operation. A schematic flow chart of the tow processing operation is illustrated in FIG. 15. In this operation the tow is heated so as to minimize the drafting tension. It is subjected to "drafting" by applying a fixed speed differential between the sets of rolls. Subsequently, it is crimped/heat-set/lubricated and cut into staple. The tow processing line consists of a creel, three sets of drafting rolls, a first stage drafting bath, a superheated steam chest, a constant length heat-set cabinet, a crimper, tow dryer-heatsetter, lubricant spray booth, and fiber cutting equipment. The drafting rolls are 0.86 meters in circumference. The speed of the first set of draft rolls is set at 11.8 MPM. The first stage draft bath is heated by 90 psi steam, which is circulated through coils located at the bottom of the bath. A pump is also attached to the bath to permit circulation of its contents. Adjustable scrubber bars in the bath allow for a change in the tension slippage of the tow band in the drafting media. At the bath exit, there is a set of wiping bars, which remove excess water from the tow band. For examples illustrating the present invention, caustic solution (various concentrations) is present in the bath. The bath temperature is maintained at 68°±2° C. Following the bath, the tow band is threaded onto a second set of drafting rolls. A first stage draft ratio of 2.33 is typical, i.e., the speed of the second set of draft rolls is 27.5 MPM. An average residence time of 2 to 3 seconds is maintained in the first bath. Next, the tow band is threaded through the steam chest. It is an 8-foot long cabinet which is heated by passing 600 psi steam through internal coils and superheated 90 psi steam inside the chest. An average residence time of about 2 seconds is maintained in the steam chest. Following the steam chest, the tow band is threaded onto the third set of draft rolls, which is typically maintained at 40 MPM, thus the overall draw-ratio is typically 3.4 for the entire process, thus far.

After passing through the third set of draft rolls, the tow band is threaded through the constant length heat set cabinet. This cabinet contains six rolls (3 sets of 2 rolls each), 1.66 meters (M) in circumference which are electrically heated. The speeds of each set of rolls can be varied individually by means of proportional/integral variable (PIV) drives. An average residue time of about 6 to 7 seconds is maintained in the constant length heat-set unit. The tow is then neutralized, if applicable, with 5% acetic acid and crimped.

The tow dryer-heat setter consists of a perforated moving belt or apron which moves through an enclosure in which hot air is circulated through the tow and apron. The enclosure is divided into two compartments whose air temperature can be controlled almost independently. The air is heated by steam coils containing 600 psi steam and is circulated by a fan driven by a 20 horsepower (HP) motor. Cooling coils are located in the ducts of the first compartment (Zone 1) in which cooling water may be circulated, if required, to reduce the temperature of Zone 1. Normal residence time of 5 minutes is maintained in the tow dryer heatsetter unit. The dryer temperature in both zones is maintained at 65° C.

The tow band is next threaded over a guide and through a slit in the bottom of the lubricant spray booth, then out a slit at the top. As it passes through the booth, four paint-type spray guns spray atomized lubricant uniformly over the tow. Each spray gun is supplied with a lubricant by a Zenith pump, which pumps the material from an adjacent reservoir.

Next, the tow band is threaded through tension bars into the cutting equipment. The cutters pull the tow band from the tow dryer-heatsetter through the lubricant spray booth and into the cutter. Staple lengths of 1½-inch are cut and stored. The cutter was used in the following examples is substantially the same as described in U.S. Pat. No. 3,485,120.

Textile Processing

The staple fibers obtained from the tow processing operation are further processed on textile processing units to obtain knit fabrics or socks. The various steps involved are opening and feeding of staple fibers to carding, drawing, roving, spinning, and knitting units. Fiber Controls vertical fine opener and blending line are used to feed the fibers to a Saco Lowell 40-inch stationary flat top card with a single delivery unit via a Snowflaker Chute Feed System ML5. The carded web is drawn on a Reiter DO/2 draw frame-3/5 unit. Following the roving operation on a Platt Saco Lowell Rovamatic FC-LC roving machine with a 32 position, magnadraft system, the yarn is spun on a Saco Lowell SF-15-F spinning frame with 96 positions and then coned on a 10-position Schlafhorst Autoconer winder. Knit fabrics are made on 26-inch diameter Scott and Williams RSTW fancy 20 cut jersey knitting machine. Knit socks are made on Lawson Hemphill sock knitter machine with a 54 gauge head.

Scouring Procedure

The knit fabrics/socks are scoured in 1% Silvatol AS® anionic surfactant (Ciba Geigy Corporation) solution in distilled water. The solution also contains 0.5% of soda ash. The bath ratio (vol of distilled water/-weight of fabrics) is maintain®d at 20/1 and scouring is carried out for 15 minutes at 180° F. Subsequently, the fabric samples are rinsed with hot distilled water at 180° F for 5 minutes followed by a rinse with distilled water at ambient temperature for 5 minutes. The samples are air dried at ambient conditions for at least 24 hours before being subjected to wettability test.

Test Methods

Fabric Wettability Test: American Association of Textile Chemists and Colorists (AATCC) Test Method 39.1971 is followed for the evaluation of fabric wettability. In principle, a drop of water is allowed to fall from a fixed height on to the taut surface of a test specimen. The time required for the specular reflection of the water drop to disappear is measured and recorded as wetting time. The smaller the wetting time, the better the fabric wettability. Wettability test was conducted on knit fabrics or knit socks made typically from 20/1 or 28/1 cotton count (cc) yarns. The knit fabrics had a weight of about 4 ounce per square yard and about 37 wales and courses per inch.

Tensile Properties: The tensile properties of single fibers is determined according to the ASTM Test Method D2101-82.

EXAMPLE 1 (Comparative)

PET polymer of I.V.=0.60 was melt spun at 295° C. through a spinnerette having 450 orifices of dumb-bell shape. An orifice of such spinnerette is shown in FIG. 11. The spun fibers of about 4.5 denier per fiber (dpf) were wound at 1000 MPM. The fiber cross-section was as shown in FIG. 14. The spun fibers were processed on the tow processing line as described hereinbefore. The schematic flow chart of the tow processing operation is shown in FIG. 15. In this example, the constant length heat-set cabinet was maintained at about 173° C. The sample was collected just before the crimper, after being neutralized with 5% acetic acid solution. The processing conditions are listed below in Table I. This sample was washed in hot distilled water at 80° C. for 15 minutes and further rinsed with distilled water at ambient temperatures. It was air dried at ambient conditions for 24 hours. The electron beam (EB) Roughness of this sample was determined by using scanning electron microscope by the procedure described earlier. The EB Roughness was measured at the bottom of the groove surface and outside the groove surface. The results of the EB Roughness for this sample is also reported in Table I. It is readily observed from the data in Table I that Example 7, which was drafted in water only at the first stage drafting bath had a very low mean EB Roughness value of 0.07 at the bottom of the groove and 0.06 EB Roughness value outside the groove. Essentially, there is no statistically significant difference in EB Roughness value at the bottom of the groove and at outside the groove for Example 7.

EXAMPLE 2

Example 2 was the same as Example 1 except that it was drafted in 1.7 weight percent sodium hydroxide solution in the first stage drafting bath and the temperature at the heat-set rolls was maintained at about 146° C. As shown in Table 1, Example 2 has a mean EB Roughness of 0.11 outside the grooved surface and a mean EB Roughness value of 0.16 at the bottom of the groove. A line-scan for Example 2 at the bottom of a groove is shown in FIG. 16 and a line-scan for Example 2 outside a groove is shown in FIG. 17.

EXAMPLE 3

Example 3 was the same as Example 1 except that it was drafted in 7.5 weight percent sodium hydroxide solution in the first stage drafting bath and the temperature at the heat-set rolls was maintained at about 200° C. As shown in Table 1, Example 3 has a mean EB Roughness of 0.15 outside the groove and a mean EB Roughness of 0.26 at the bottom of the groove. For Examples 1, 2, and 3 the first stage draw ratio was 2.33 and an overall draw ratio of 3.4 was used. SEM photomicrographs of fibers of Examples 1, 2, and 3 are shown, respectively, in FIGS. 18, 19, and 20.

TABLE I

| | PROCESSING CONDITIONS | | | MEAN EB ROUGHNESS | |
|---|---|---|---|---|---|
| Example No. | % NaOH in 1st Stage Drafting Bath | Temp. (°C.) at 2nd Stage Drafting | Temp. at Heat-Set Rolls (°C.) | at the Bottom of Groove | Outside Groove |
| 1 | 0% (Water Only) | 182 | 173 | 0.07 | 0.06 |
| 2 | 1.7% | 181 | 146 | 0.16 | 0.11 |
| 3 | 7.5% | 181 | 200 | 0.26 | 0.15 |

EXAMPLE 4 (Comparative)

PET polymer of I.V.=0.60 was melt spun at 295° C. through a spinnerette having 450 orifices of dumb-bell FIG. 11. The spun fibers of about 4.5 dpf were wound at 1000 MPM. The fiber cross-section was as shown in FIG. 14. The spun fibers were processed on the tow processing line as described hereinbefore. The schematic flow chart of the tow processing operation is shown in FIG. 15. In this example, the constant length heat-set cabinet was by-passed. The tow dryer and heat-set unit were maintained at about 150° C. The fiber tow samples were drafted using the conventional two-stage drafting process, i.e., without hydrolysis. In the first stage drafting bath, water at 68° C. is used as the drafting medium. A draw ratio of 2.3 was used. In the second stage drafting, superheated steam at 190° C. was used as the drafting medium. An overall draw ratio of 3.4 was used. Average residence time during the first and second stage drafting was 3.1 seconds and 1.8 seconds, respectively. Subsequently, crimping, drying, lubrication, and cutting steps were followed to obtain 1½-inch long staple PET fibers. These samples were processed into yarns using conventional textile processing equipment. Knit socks made from these yarns were scoured and subjected to the wetting test, described hereinbefore. The wetting time was >600 seconds. The tenacity of single fibers was 4.66 g/d.

EXAMPLE 5

PET fibers as in Example 4 were subjected to the novel drafting process, i.e., 3.4% sodium hydroxide solution with 0.05% Merse 7F® quaternary ammonium salt accelerator (Trademark of Sybron Chemicals, Inc.), at 68° C. was used as the drafting medium. Acetic acid solution was used at the crimper to neutralize unreacted sodium hydroxide. The remainder of the process was essentially the same as described herein-before and in Example 4. Knit socks, thus made from the caustic treated PET fibers were scoured and subjected to the wetting test. The wetting time was only 40 seconds. The tenacity of single fibers was 4.10 g/d. When Merse 7F® was not added to the caustic bath (3.4% NaOH), the wetting time for corresponding sample was 65 seconds and the single fiber tenacity 4.52 g/d.

EXAMPLE 6 (Comparative)

PET fibers of round cross-section (spun d/f=4.7) were drafted using the conventional two-stage drafting process with water at 88° C. as the first stage drafting medium and superheated steam at 178° C. at the second stage. First stage draw ratio of 1.6 and an overall draw ratio of 1.8 was used during the drafting. This example was performed in laboratory scale equipment and no heat-set was used after the second stage drafting. Socks were knitted from the drawn fibers, scoured, and dyed using disperse dyeing. After repeating standard washing and drying cycles five times, wettability test was conducted on these samples. The wetting time was 600 seconds. The tenacity of the fibers was 4.61 g/d.

EXAMPLE 7 (Comparative)

PET fibers of round cross-section were subjected to the novel drafting process, i.e., a 3.4% sodium hydroxide solution with 0.05% Merse 7F® quaternary ammonium salt accelerator was used as the first stage drafting medium. The remainder of the procedure was same as described in Example 6. The wetting time for corresponding sample with round cross-section was 465 seconds. The tenacity of the fiber was 4.23 g/d.

EXAMPLE 8 (Comparative)

PET polymer of I.V.=0.60 was melt spun at 295° C. through a spinnerette having 450 orifices of dumb-bell shape. An orifice of such spinnerette is shown in FIG. 11. The spun fibers of about 4.5 dpf were wound at 1000 MPM. The fiber cross-section was as shown in FIG. 14. The spun fibers were processed on the tow processing line as described hereinbefore. The schematic flow chart of the tow processing operation is shown in FIG. 15. In this example, the constant length heat-set cabinet was by-passed. The tow dryer and heat-set unit were maintained at about 150° C. The fibers were drafted using the conventional two-stage drafting process, i.e., without hydrolysis. First stage draw ratio was 2.7, water temperature was 67° C., and overall draw ratio was 2.9. Socks were knit and scoured using standard procedures. The wettability test was conducted on a sock sample, which was washed and dried five times. The wettability time was >600 seconds. The tenacity of drawn fibers was 3.94 g/d.

EXAMPLE 9

PET fibers as described in Example 8 were subjected to the novel drafting process, i.e., a 2% sodium hydroxide solution was used as the first stage drafting medium. The rest of the procedure for preparing the samples was the same as described in Example 8. The wettability time was only 13.9 seconds for the corresponding sample. The tenacity of the corresponding fiber was 3.35 g/d.

EXAMPLES 10–29

Examples 10–29 show additional data obtained for various runs using different processing conditions listed in Table II below. PET polymer of I.V.=0.60 was melt spun at 295° C. through a spinnerette having 450 orifices of dumb-bell shape. An orifice of such spinnerette is shown in FIG. 11. The spun fibers of about 4.5 dpf were wound at 1000 MPM. The fiber cross-section was as shown in FIG. 14. While processing the tow samples, according to the flow chart in FIG. 15, the constant length heat-set cabinet was bypassed. The temperature in the tow dryer was maintained at 150°±5° C. A first stage draw ratio of 2.33 and an overall draw ratio of 3.4 was maintained. The fabrics made from fibers of Examples 10–28 had an improved cover and a distinctive hand as compared to fabrics made from fibers of comparative Example 29. Note the improved wettability of fabrics made from fibers of the present invention, as compared to fabrics made from fibers of comparative Examples 20 and 29. Examples 23 and 24 illustrate the use of KOH and $Na_2CO_3$, respectively, as the alkaline material instead of NaOH.

TABLE II

| Example No. | % NaOH in First-Stage Draft Bath | % Merse 7F in First-Stage Draft Bath | Second-Stage Draw Temperature (°C.) | Fiber Cross-Section Shape | Drawn DPF | Tenacity (GPD) | % Elong. | Initial Modulus (GPD) | Toughness (GPD) | Wettability (Sec.) |
|---|---|---|---|---|---|---|---|---|---|---|
| | | | Summary of Data for Examples 10–19 | | | | | | | |
| 10 | 1.42 | 0.05 | 220 | Substantially as Shown in Figure 14 | 1.45 | 5.29 | 40.8 | 39.2 | 1.22 | 65 |
| 11 | 0.30 | 0.0 | 169 | Substantially as Shown in Figure 14 | 1.80 | 4.42 | 55.4 | 26.6 | 1.49 | 408 |
| 12 | 3.4 | 0.05 | 190 | Substantially as Shown in Figure 14 | 1.76 | 4.10 | 47.0 | 23.6 | 1.09 | 40 |
| 13 | 2.7 | 0.05 | 211 | Substantially as Shown in Figure 14 | 1.82 | 4.12 | 45.6 | 18.3 | 1.04 | 48 |
| 14 | 3.05 | 0.05 | 169 | Substantially as Shown in Figure 14 | 1.78 | 4.21 | 47.2 | 21.0 | 1.105 | 24 |
| 15 | 1.46 | 0.05 | 160 | Substantially as Shown in Figure 14 | 1.61 | 4.42 | 51.6 | 31.0 | 1.45 | 48 |
| 16 | 0.33 | 0.05 | 169 | Substantially as Shown in Figure 14 | 1.42 | 5.05 | 49.6 | 41.2 | 1.63 | 287 |
| 17 | 2.63 | 0.0 | 169 | Substantially as Shown in Figure 14 | 1.62 | 4.52 | 42.2 | 31.2 | 1.09 | 65 |
| 18 | 0.37 | 0.05 | 211 | Substantially as Shown in Figure 14 | 1.57 | 4.75 | 48.7 | 36.2 | 1.36 | 448 |
| 19 | 2.57 | 0.0 | 211 | Substantially as Shown in Figure 14 | 1.68 | 4.0 | 36.6 | 27.3 | 0.79 | 27 |
| | | | Summary of Data for Examples 20–29 | | | | | | | |
| 20 (Comparative) | 0.0 | 0.0 | 190 | Substantially as Shown in Figure 14 | 1.49 | 4.64 | 50.5 | 28.1 | 1.52 | 500 |
| 21 | 1.59 | 0.0 | 211 | Substantially as Shown in Figure 14 | 1.55 | 4.6 | 53.1 | 30.1 | 1.52 | 185 |
| 22 | 1.36 | 0.05 | 190 | Substantially as Shown in Figure 14 | 1.60 | 4.36 | 43.8 | 35.4 | 1.185 | 51 |
| 23 | 0.87 (KOH) | 0.05 | 190 | Substantially as Shown in Figure 14 | 1.67 | 4.44 | 52.5 | 28.5 | 1.57 | 68 |
| 24 | 1.73 ($Na_2Co_3$) | 0.05 | 190 | Substantially as Shown in Figure 14 | 1.55 | 4.53 | 49.4 | 27.8 | 1.41 | 178 |
| 25 | 5.36 | 0.05 | 220 | Substantially as Shown in Figure 14 | 1.47 | 4.82 | 47.1 | 26.7 | 1.30 | — |
| 26 | 5.41 | 0.05 | 230 | Substantially as Shown in Figure 14 | 1.58 | 4.57 | 40.4 | 29.2 | 0.98 | — |
| 27 | 8.8 | 0.05 | 230 | Substantially as Shown in Figure 14 | 1.72 | 3.76 | 33.8 | 31.5 | 0.67 | — |
| 28 | 9.28 | 0.05 | 230 | Substantially | 1.58 | 4.29 | 35.3 | 35.4 | 0.87 | — |

TABLE II-continued

| Example No. | % NaOH in First-Stage Draft Bath | % Merse 7F in First-Stage Draft Bath | Second-Stage Draw Temperature (°C.) | Fiber Cross-Section Shape | Drawn DPF | Tenacity (GPD) | % Elong. | Initial Modulus (GPD) | Toughness (GPD) | Wettability (Sec.) |
|---|---|---|---|---|---|---|---|---|---|---|
| | | | | as Shown in Figure 14 | | | | | | |
| 29 (Comparative) | 0.48 | 0.05 | 211 | Round | 1.59 | 3.88 | 60.1 | 30.7 | 1.71 | 489 |

EXAMPLES 30–71

Examples 30–71 show further data obtained for various runs using different processing conditions listed in Table III below. No Merse 7F® was used in Examples 30–50. 0.2% Merse 7F® was used in Examples 51–71. All fibers had cross-section shape substantially as shown in FIG. 14. In these examples, while processing the tow samples according to the flow chart in FIG. 15, the temperature of the constant length heat-set cabinet was set as per conditions listed in Table III. The tow dryer temperature was maintained at 65°±5° C. A first stage draw ratio of 2.33 and an overall draw ratio of 3.4 was maintained. Note the increased wettability of fabrics made from fibers treated with sodium hydroxide solution as compared to those for comparative Examples 30 and 51.

TABLE III

| Example No. | % NaOH in First-Stage Draft Bath | Heat Set Temperature (°C.) | Res. Time at Heat Set Temperature (Sec.) | Drawn Den. (DPF) | Tenacity (GPD) | % Elong. | Initial Modulus (GPD) | Toughness (GPD) | Wettability (Sec.) |
|---|---|---|---|---|---|---|---|---|---|
| | | | Summary of Data for Examples 30–40 | | | | | | |
| 30 (Comparative) | 0.0 | 173 | 10 | 1.49 | 5.27 | 33.9 | 59.3 | 1.312 | >600 |
| 31 | 9.7 | 173 | 10 | 1.48 | 2.39 | 10.8 | 58.1 | 0.170 | |
| 32 | 4.6 | 173 | 10 | 1.33 | 3.00 | 8.3 | 68.2 | 0.160 | |
| 33 | 4.8 | 173 | 10 | 1.46 | 2.72 | 10.3 | 62.6 | 0.180 | |
| 34 | 7.5 | 200 | 8 | 1.24 | 2.86 | 8.8 | 68.7 | 0.160 | |
| 35 | 2.0 | 200 | 12 | 1.44 | 3.20 | 12.5 | 52.9 | 0.240 | 42 |
| 36 | 8.0 | 146 | 12 | 1.33 | 3.20 | 12.8 | 52.4 | 0.260 | 115 |
| 37 | 1.8 | 146 | 8 | 1.40 | 3.69 | 17.4 | 51.4 | 0.410 | 47 |
| 38 | 5.0 | 130 | 10 | 1.41 | 3.43 | 17.5 | 50.7 | 0.390 | 106 |
| 39 | 4.9 | 173 | 10 | 1.32 | 3.23 | 9.3 | 69.6 | 0.180 | 317 |
| 40 | 3.6 | 173 | 10 | 1.39 | 2.62 | 8.1 | 65.5 | 0.140 | 62 |
| | | | Summary of Data for Examples 41–50 | | | | | | |
| 41 | 4.6 | 216 | 10 | 1.30 | 2.25 | 10.6 | 60.1 | 0.150 | |
| 42 | 4.6 | 173 | 10 | 1.51 | 2.85 | 9.0 | 67.2 | 0.154 | |
| 43 | 4.5 | 173 | 14 | 1.32 | 2.97 | 9.9 | 67.1 | 0.180 | |
| 44 | 4.6 | 173 | 10 | 1.33 | 3.04 | 9.4 | 71.1 | 0.190 | |
| 45 | 4.7 | 173 | 6 | 1.30 | 3.39 | 11.5 | 71.6 | 0.240 | |
| 46 | 1.7 | 146 | 12 | 1.36 | 3.40 | 17.1 | 67.3 | 0.420 | 17 |
| 47 | 6.7 | 146 | 8 | 1.27 | 3.30 | 10.1 | 61.8 | 0.190 | |
| 48 | 7.0 | 200 | 12 | 1.26 | 2.15 | 12.6 | 45.0 | 0.170 | |
| 49 | 1.6 | 200 | 8 | 1.40 | 3.00 | 10.8 | 59.1 | 0.210 | |
| 50 | 4.1 | 210 | 8 | 1.54 | 2.65 | 11.3 | 58.9 | 0.210 | |
| | | | Summary of Data for Examples 51–60 | | | | | | |
| 51 (Comparative) | 0.0 | 173 | 10 | 1.49 | 5.27 | 33.9 | 59.3 | 1.310 | >600 |
| 52 | 9.7 | 173 | 10 | | | | | | |
| 53 | 4.6 | 173 | 10 | 1.33 | 3.91 | 15.8 | 55.2 | 0.350 | |
| 54 | 4.8 | 173 | 10 | 1.23 | 3.00 | 8.9 | 68.1 | 0.180 | |
| 55 | 7.5 | 200 | 8 | | | | | | |
| 56 | 2.0 | 200 | 12 | 1.34 | 3.43 | 13.7 | 64.8 | 0.280 | 23 |
| 57 | 8.0 | 146 | 12 | 1.22 | 3.32 | 13.2 | 62.3 | 0.270 | 31 |
| 58 | 1.8 | 146 | 8 | 1.31 | 3.88 | 17.9 | 61.2 | 0.440 | 24 |
| 59 | 5.0 | 130 | 10 | 1.34 | 3.45 | 16.1 | 61.2 | 0.390 | |
| 60 | 4.9 | 173 | 10 | 1.24 | 2.67 | 9.1 | 63.3 | 0.160 | |
| | | | Summary of Data for Examples 61–71 | | | | | | |
| 61 | 3.6 | 173 | 10 | 1.36 | 3.71 | 11.9 | 72.3 | 0.270 | |
| 62 | 4.6 | 216 | 10 | | | | | | |
| 63 | 4.6 | 173 | 10 | 1.05 | 3.71 | 9.3 | 75.1 | 0.220 | |
| 64 | 4.5 | 173 | 14 | 1.33 | 3.23 | 9.8 | 67.5 | 0.200 | |
| 65 | 4.6 | 173 | 10 | 1.19 | 2.84 | 11.3 | 59.2 | 0.220 | 26 |
| 66 | 4.7 | 173 | 6 | 1.43 | 2.66 | 8.8 | 68.8 | 0.160 | |
| 67 | 1.7 | 146 | 12 | 1.58 | 2.95 | 19.1 | 53.5 | 0.426 | 21 |
| 68 | 6.7 | 146 | 8 | 1.34 | 3.39 | 13.2 | 59.0 | 0.290 | 180 |
| 69 | 7.0 | 200 | 12 | 1.28 | 3.58 | 12.9 | 62.5 | 0.280 | |
| 70 | 1.6 | 200 | 8 | 1.48 | 2.65 | 12.1 | 75.8 | 0.220 | 154 |
| 71 | 4.6 | 210 | 8 | 1.40 | 2.94 | 13.9 | 60.4 | 0.270 | |

EXAMPLES 72–79

Experimental ink reservoirs were prepared by wrapping fiber around a 4 inch diameter bottle. The loop of fiber was removed and pulled through a 5 mm diameter by 4 inch soda straw with a wire. The fibers were cut flush with the end of the soda straw, and individual fibers were removed until the density of the fibers within the tube was approximately 0.337 g/cc. It had previously been determined that a commercial pen reservoir from American Filtrona had a fiber density of 0.337 g/cc.

An aqueous ink believed to be representative of a commercial rollerball ink was prepared from 60 g of water, 40 g of ethylene glycol, 30 g of a first polyester dispersion, 20 g of a second polyester dispersion, 40.8 g of Hoechst Black Disperse A and 0.42 g of Surfonyl 104E, a non-ionic surfactant. The first polyester dispersion is a 30 wt. % dispersion of an isophthalic acid based water-dispersible polyester in water; The second polyeter dispersion is a 28 wt. % dispersion of an isophthalic acid based water-dispersible polyester in water, and Hoechst Black Disperse A is a 40 wt. % solids dispersion of carbon black in water. The resultant ink had a viscosity of 3.5 cps, a pH of 6.1 and a surface tension of 40 dynes/cm.

About 10 g of ink was placed in a small aluminum dish on an analytical balance. The ink reservoir to be tested was supported in a vertical position above the ink, with the end of the reservoir immersed in the ink but not touching the bottom of the pan. The amount of ink absorbed by the reservoir could be determined by the decrease in weight of the pan of ink, and it was possible to monitor the absorbance of ink with time. The maximum weights of ink absorbed by reservoirs made from various fibers are tabulated below.

Summary of Experimental Data for Fibers As Liquid Aqueous Ink Pen Reservoirs

| Example No. | Cross Section Shape | Caustic Drafted? | Dpf | No. Fil. | Weight Fiber | Total Ink Absorbed |
|---|---|---|---|---|---|---|
| 72 | Z | Yes | 2.37 | 100 | .43 g | 1.52 g |
| 73 | Z | No | 2.13 | 100 | .43 g | 1.06 g |
| 74 | Round | Yes | 2.92 | 36 | .43 g | .56 g |
| 75 | Round | No | 2.92 | 36 | .43 g | .52 g |
| 76 | Round | Yes | 1.30 | 1070 | .43 g | .66 g |
| 77 | Round | No | 1.28 | 1070 | .43 g | .73 g |
| 78 | Y | No | Unk | Unk | .42 g | 1.62 g |

-continued

Summary of Experimental Data for Fibers As Liquid Aqueous Ink Pen Reservoirs

| Example No. | Cross Section Shape | Caustic Drafted? | Dpf | No. Fil. | Weight Fiber | Total Ink Absorbed |
|---|---|---|---|---|---|---|
| 79 | Y | No | Unk | Unk | .42 g | 1.62 g |

Figure 5:
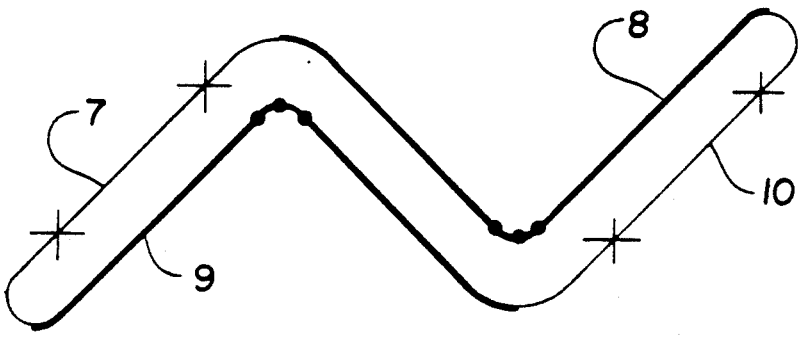
FIG. 5—Schematic representation of a cross-section of a polyester fiber having two grooves. The "+" symbols represent points outside the grooves; the "~" symbols represent points at the bottom of the grooves; the thicker lines (8, 9) represent the groove surfaces; and the thinner lines (7, 10) represent the non-groove surfaces.
Figure 6:
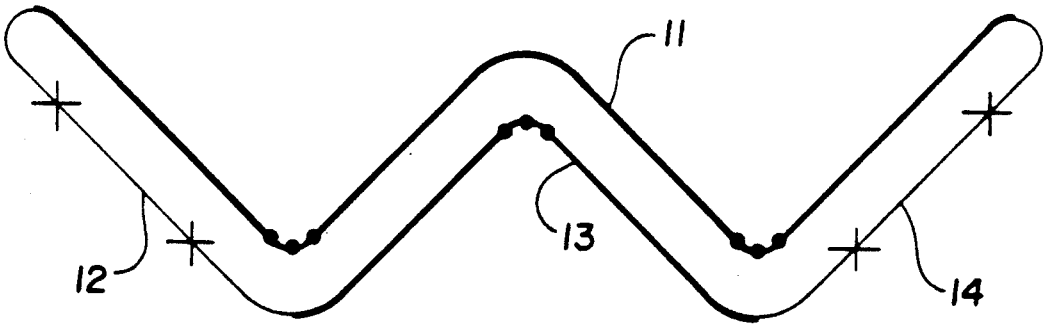
FIG. 6—Schematic representation of a cross-section of a polyester fiber having three grooves. The "+" symbols represent points outside the grooves; the "•" symbols represent points at the bottom of the grooves; the thicker lines (11, 13) represent the groove surfaces; and the thinner lines (12, 14) represent the non-groove surfaces.
Figure 7:
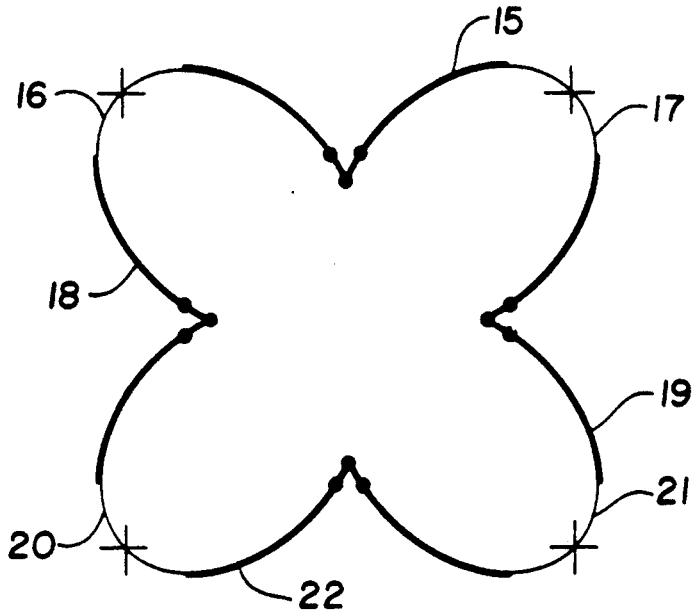
FIG. 7—Schematic representation of a cross-section of a polyester fiber having four grooves. The "+" symbols represent points outside the grooves; the "•" symbols represent points at the bottom of the grooves; the thicker lines (15, 18, 19, 22) represent the groove surfaces; and the thinner lines (16, 17, 20, 21) represent the non-groove surfaces.

Six reservoirs made from experimental fibers (Examples 72–77) comprised of poly(ethylene terephthalate) and two commercial reservoirs (Examples 78–79) comprised of cellulose acetate were evaluated. Examples 72 and 73 are examples of the invention whereas Examples 74–79 are comparative examples. Example 78 was obtained from Accutec Corporation. Example 79 was obtained from American Filtrona, Stock #R-10166. Caustic drafted (i.e., process substantially as described in Example 5 hereof) and water drafted versions of two deniers of round fibers and of a fiber with a Z-shaped cross-section were evaluated. The Z-shaped fibers had a cross-section substantially as shown in FIG. 5 hereof The results show that the reservoirs made from fibers with a Z-shaped cross-section (Examples 72 and 73) absorbed more ink than any of the reservoirs made from fibers having a round cross-section (Examples 74–77). The results also demonstrate that the reservoir made from caustic-drafted fibers with a Z-shaped cross-section (Example 72) was comparable to commercial reservoirs (Examples 78 and 79).

The invention has been described in detail with particular reference to preferred embodiments thereof, but it will be understood that variations and modifications can be effected within the spirit and scope of the invention.

We claim:

1. A writing instrument comprising an ink reservoir which comprises a plurality of fibers wherein one or more individual fibers of said plurality of fibers is a polyester fiber having formed therein and extending along the length thereof at least one continuous groove, wherein the mean EB roughness at the bottom of said groove is about 10% to about 600% higher than the mean EB Roughness outside said groove and the mean EB Roughness outside said groove is about 0.06 $\mu$ to about 0.20 $\mu$, and wherein said polyester fiber has $L_1/L_2 > 1.2$, where $L_1$ and $L_2$ are the respective major and minor axes of the cross-section.

2. The writing instrument of claim 1, wherein said reservoir contains an aqueous ink.

* * * * *